United States Patent [19]

Mikulski

[11] 4,006,774

[45] Feb. 8, 1977

[54] DIE CASTING APPARATUS WHICH ELIMINATES SHOT SLEEVE-METAL CONTACT

[75] Inventor: Walter Edward Mikulski, Glastonbury, Conn.

[73] Assignee: United Technologies Corporation, Hartford, Conn.

[22] Filed: May 19, 1976

[21] Appl. No.: 687,772

[52] U.S. Cl. ..... 164/312; 164/113; 425/242 R

[51] Int. Cl.[2] ..... B22D 17/08

[58] Field of Search ..... 164/303, 312, 314, 316, 164/317, 113; 425/242 R, DIG. 228

[56] References Cited

UNITED STATES PATENTS

| | | | |
|---|---|---|---|
| 2,932,865 | 4/1960 | Bauer | 164/312 X |
| 3,528,478 | 9/1970 | Koch et al. | 164/113 |
| 3,901,306 | 8/1975 | Miki et al. | 164/312 |

FOREIGN PATENTS OR APPLICATIONS

| | | | |
|---|---|---|---|
| 1,578,340 | 8/1969 | France | 164/113 |

*Primary Examiner*—Ronald J. Shore
*Assistant Examiner*—Gus T. Hampilos
*Attorney, Agent, or Firm*—Edward J. Timmer

[57] ABSTRACT

Disclosed is a casting machine in which first and second die halves define a die cavity in the shape of the article to be cast and a narrow runner opening into the cavity. A shot sleeve, having an upwardly oriented injection chamber, is connected to one of said die halves such that the top end of the injection chamber is in communication with the runner. A plunger, disposed for reciprocating motion in the chamber, has an upper face including a concavity for receiving sufficient casting material, such as molten metal, to form the article and for carrying the casting material out of contact of the shot sleeve when the plunger is advanced upwardly in the chamber. At least one of said die halves further defines a convexity projecting into the chamber, the convexity being adapted to cooperatively mate with the concavity and displace the casting material therefrom, through the runner and into the die cavity when the plunger is advanced to the top of the chamber. Contact between the casting material and shot sleeve and the problems associated therewith are essentially eliminated with the improved casting machine.

8 Claims, 3 Drawing Figures

FIG. 1
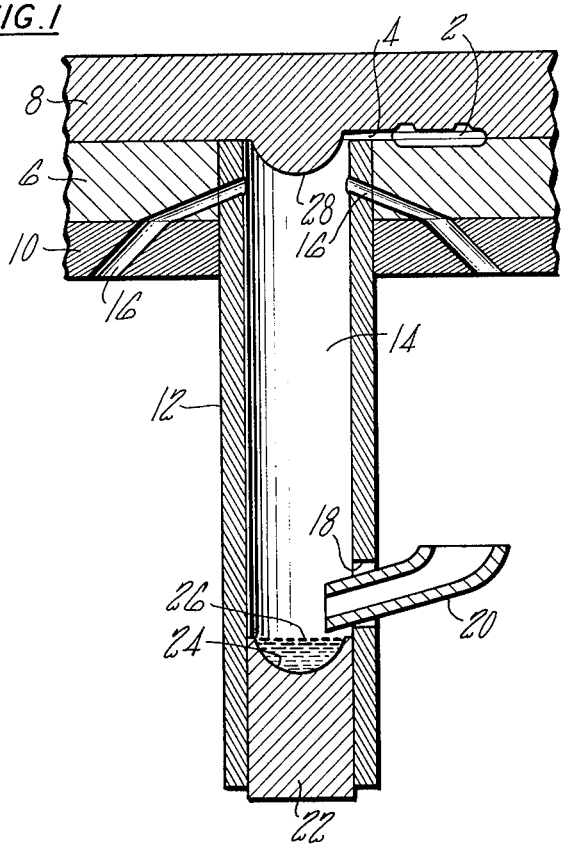
FIG. 2
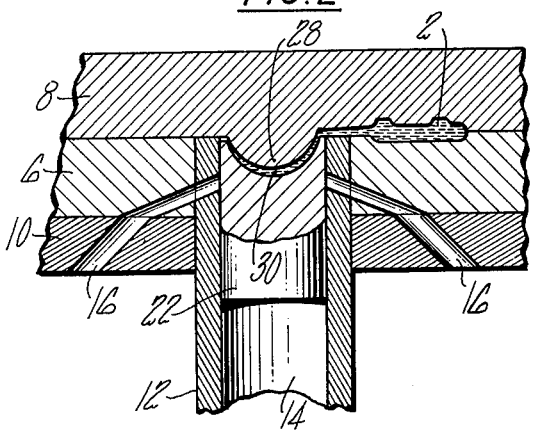
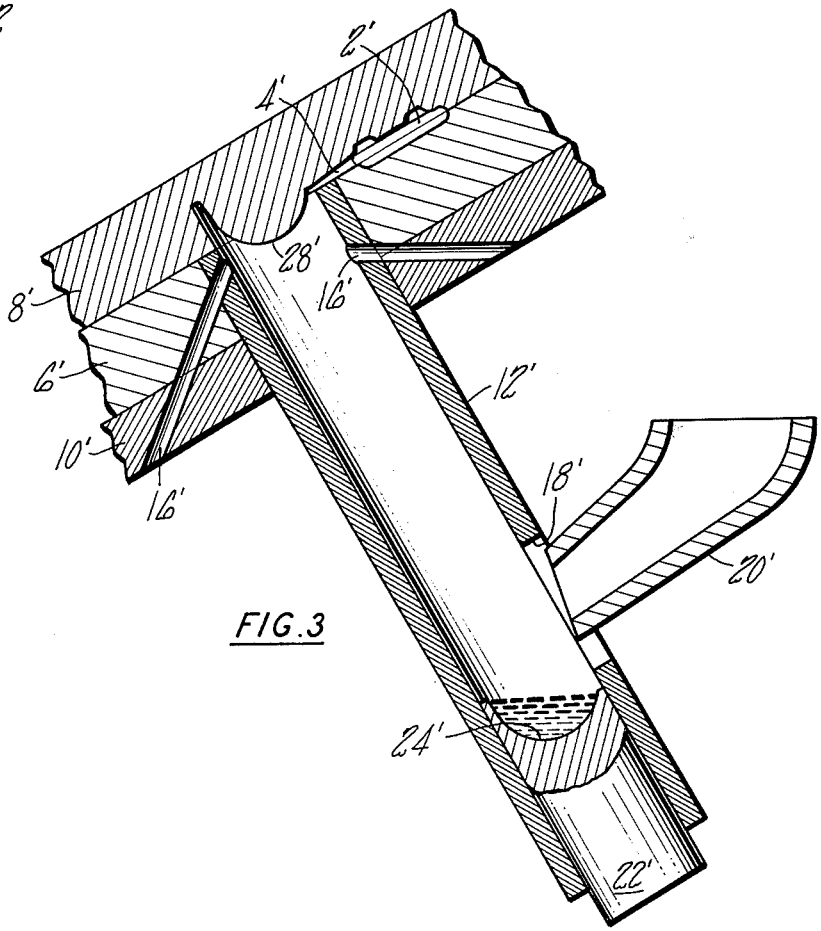
FIG. 3

DIE CASTING APPARATUS WHICH ELIMINATES SHOT SLEEVE-METAL CONTACT

BACKGROUND OF THE INVENTION

1. Field of the Invention

The present invention relates to casting machines of the type generally referred to as die casting machines.

2. Description of the Prior Art

Die casting machines and processes are well known in the prior art. Generally, a die casting machine consists of a fixed die half and a movable die half which define a die cavity therebetween in the shape of the article to be cast. The die halves also define a gate or runner which is a narrow passageway opening into the die cavity. A vertically or horizontally oriented shot sleeve, having an injection chamber therein, is connected to the fixed die half in such a manner that the outlet end of the injection chamber communicates with the die cavity via the gate or runner. Positioned for reciprocating motion within the injection chamber of the shot sleeve is a plunger. A charge of casting material, such as molten metal, is introduced into the shot sleeve through a suitable opening ahead of the plunger and the plunger is then advanced in the injection chamber to force the charge through the gate or runner and into the die cavity where solidification occurs. The movable die half is thereafter withdrawn so that the solidified casting can be removed.

Prior art die casting machines generally suffer from several disadvantages. Galling and binding between the plunger and shot sleeve is a major problem attributable to the charge, such as molten metal, becoming entrapped in the clearance between the plunger and shot sleeve and solidifying there into abrasive particles or flash. Rapid wear of the plunger and shot sleeve occurs and leads to reduced machine efficiency and component life. As exemplified in U.S. Pat. Nos. 2,932,865 and 3,091,306 prior art workers have attempted to overcome this problem by providing a deformable cup-like extension or sealing member at the plunger face to prevent entrapment of the charge in the clearance. Other problems arise as a result of introducing the molten charge directly into the shot sleeve chamber prior to injection in the die cavity. When molten charge contacts the shot sleeve, the charge may be rapidly chilled, and possibly prematurely solidified. Chilling of a molten metal charge adversely affects its fluidity and ability to form a sound casting. In addition, contact between the shot sleeve and molten charge tends to warp and crack the shot sleeve as a result of temperature differentials set up in the sleeve. Warping and cracking of the shot sleeve are an especially severe problem when metals or alloys having high melting temperatures, such as steels, are being cast.

SUMMARY OF THE INVENTION

It is an object of the present invention to provide a casting machine especially useful in casting molten metals and alloys, particularly those of high melting points, into desired articles and which overcomes the disadvantages of the prior art.

The present invention involves an improved die casting machine in which first and second die halves define a die cavity in the shape of the article to be cast and a narrow runner opening into the cavity and in which a shot sleeve, having an upwardly oriented injection chamber, is connected to one of the die halves such that the top end of the injection chamber is in communication with the runner. An important feature of the present invention is a plunger disposed for reciprocating movement in the injection chamber, the upper face of the plunger including a concavity for receiving at least sufficient casting material, such as a molten metal charge, to form the desired article and for carrying the casting material out of contact of the shot sleeve when the plunger is advanced upwardly in the injection chamber. Another important feature of the invention is at least one die half which further defines a convexity projecting into the top end of the injection chamber, the convexity being suitably positioned and shaped to cooperatively mate with the concavity and displace the casting material therefrom, through the runner and into the die cavity when the plunger is advanced to the top end of the injection chamber. These features, in combination, substantially eliminate contact between the shot sleeve and molten charge and, consequently, the numerous problems associated therewith. The present invention permits a wider range of materials, including higher melting point metals and alloys, to be die cast than has heretofore been possible.

Other objects and advantages of the present invention will appear more fully from the following drawings and description of the preferred embodiment.

BRIEF DESCRIPTION OF THE DRAWINGS

FIG. 1 is a vertical sectional view through the casting machine with the plunger in position to receive a charge of casting material.

FIG. 2 is a vertical sectional view through the casting machine with the concavity and convexity cooperatively mated to force the charge into the die cavity.

FIG. 3 is a vertical sectional view of a casting machine in which the shot sleeve has an inclined injection chamber.

DESCRIPTION OF THE PREFERRED EMBODIMENT

Although the present invention is especially useful in die casting molten metals and alloys, especially those of high melting points, it is not so limited. Other materials, such as ceramics, refractories, glasses, plastics and the like, may also be readily cast in the casting machine of the present invention.

Referring first to FIG. 1, a die cavity 2 in the shape of the article to be cast and a narrow runner 4 opening into the cavity are formed between cooperating first and second die halves 6 and 8, the first die half being attached to fixed die support plate 10 and the second die half being movable with respect to the first. A shot sleeve 12 having vertical injection chamber 14 extends through support plate 10 and first die half 6 is attached thereto such that the top of the injection chamber communicates with the die cavity by way of runner 4 in accordance with the usual prior art practice. Preferably, near the top of chamber 14 are air discharge vents 16 which pass through the shot sleeve, first die half and support plate to the outside atmosphere. A pouring port 18 is provided in the shot sleeve so that pouring spout 20 may be inserted into the lower end of the injection chamber for introduction of a charge of casting material, such as molten metal, therein.

Disposed for reciprocable movement in the injection chamber is plunger 22. According to the invention the plunger has an upper face including concavity 24. Concavity 24 is adapted to receive at least sufficient casting material from pouring spout 20 to form the desired article and to carry the casting material in spaced relation to the shot sleeve; i.e., out of contact of the shot sleeve, when the plunger is advanced upwardly in the injection chamber. In FIG. 1, the plunger is shown positioned below the pouring spout for introduction of a molten metal charge 26 into concavity 24. After the desired quantity of molten metal is poured into the concavity, the pouring spout is withdrawn from the injection chamber and the plunger is advanced by conventional means, such as a hydraulic ram, toward the die cavity. During advancement, the molten metal charge is carried in the concavity out of contact with the shot sleeve. As the plunger advances in the injection chamber, air present therein is discharged through vents 16, thereby reducing porosity in the cast article. As shown in FIG. 2, second die half 8 has a convexity 28 projecting therefrom into the injection chamber. The convexity is shaped and positioned to cooperatively mate with the concavity when the plunger is advanced to the top of the injection chamber and thereby displace the molten metal charge from the concavity, forcing the charge through runner 4 and into the die cavity. After the molten charge solidifies, second die half 8 is withdrawn to expose the cast article for physical removal from the die cavity. Plunger 22 is repositioned as shown in FIG. 1 to repeat the casting cycle.

An embodiment of the present invention in which the injection chamber of the shot sleeve is inclined relative to vertical is illustrated in FIG. 3 wherein like numerals represent like features. This embodiment possesses all the features and advantages of the preferred casting machine described above and is additionally advantageous in that a stationary pouring spout 20' may be utilized to introduce the molten charge into the concavity. Insertion and retraction of the pouring spout is not required.

In the practice of the present invention, the concavity and convexity may have any suitable shape, such as hemispherical, as shown, rectangular, triangular and the like, so long as the concavity can receive sufficient casting material to form the article and can carry the casting material out of contact of the shot sleeve and so long as the convexity cooperatively mates with the concavity to displace the casting material therefrom, through the runner and into the die cavity. Preferably, a clearance is provided between the concavity and convexity when they are cooperatively mated so that a thin shell 30 or "biscuit" is formed in connection with the cast article as shown in FIG. 2.

It will now be understood that the significant disadvantages of prior art die casting machines can be overcome by the present invention. Galling and binding of the shot sleeve and plunger and warping of the shot sleeve, all resulting from contact of the molten metal charge with the shot sleeve, are drastically reduced. Chilling and premature freeze-up of the molten charge are also reduced since the charge is in contact with a smaller area of conductive surface. If desired, chilling of a molten metal charge may be further minimized by heating the plunger, such as by induction means outside the shot sleeve, or by providing a ceramic insert or coating between the charge and concavity for insulation purposes. The provision of air discharge vents near the top end of the injection chamber greatly reduces porosity in the cast article. The cast article produced by the casting machine will thus exhibit superior quality.

The casting machine of the present invention permits a wider selection of casting materials, including metals and alloys of high melting points, to be die cast than has heretofore been possible. For example, stainless steels having melting temperatures of 2100° F and above may be readily cast with the present invention. In casting such alloys, the plunger and die halves are made of materials, such as TZM molybdenum alloy, TRW 2278 nickel base alloy or the nickel base alloy of U.S. Pat. No. 3,655,462, which are capable of withstanding the elevated temperature of the molten charge. The shot sleeve may be made of the ordinary material, such as low carbon alloy steel or tool steel, used for such purpose.

Although the invention has been shown and described with respect to illustrative embodiments thereof, it will be understood by those skilled in the art that changes and additions in the form and detail thereof may be made therein without departing from the spirit and scope of the invention.

Having thus described typical embodiments of my invention, that which I claim as new and desire to secure by Letters Patent of the United States is:

1. In a casting machine for the production of cast articles wherein first and second die halves cooperate to define a die cavity in the shape of the article to be cast and a narrow runner opening into said cavity, the improvement which comprises, in combination:

a. a shot sleeve having an upwardly oriented injection chamber extending therethrough, the shot sleeve being connected to one of said die halves such that a portion of said shot sleeve defining a top end of the injection chamber is in communication with the runner opening into the die cavity, the shot sleeve having access means in a portion of said shot sleeve defining a lower end of the injection chamber through which casting material, such as a molten metal charge, is introduced;

b. a plunger disposed for reciprocating motion in the injection chamber, the upper face of the plunger including a concavity for receiving at least sufficient casting material to form the article and for carrying the casting material out of contact of the shot sleeve when the plunger is advanced upwardly in the injection chamber;

c. at least one die half which further defines a convexity projecting into the top of the injection chamber, the convexity being suitably positioned and shaped to cooperatively mate with the concavity in the upper face of the plunger and displace casting material therefrom, through the runner and into the die cavity when the plunger is advanced to the top of the chamber.

2. The casting machine of claim 1 wherein the injection chamber of the shot sleeve is vertically oriented.

3. The casting machine of claim 1 wherein the die cavity and runner are defined by upper and lower die halves, the shot sleeve being connected to the lower die half.

4. The casting machine of claim 3 wherein the upper die half further defines the convexity.

5. The casting machine of claim 1 wherein the concavity and convexity are hemispherical in form.

6. The casting machine of claim 1 wherein a clearance is provided between the cooperatively mated concavity and convexity such that a thin shell is formed in connection with the cast article.

7. The casting machine of claim 1 wherein the shot sleeve has air discharge vents passing therethrough to connect the top of the injection chamber to the outside atmosphere, air in the chamber being forced out said vents when the plunger is advanced upwardly in the chamber.

8. The casting of claim 1 wherein the molten metal charge is molten steel.

* * * * *